US010924864B2

(12) United States Patent
Xiao

(10) Patent No.: US 10,924,864 B2
(45) Date of Patent: Feb. 16, 2021

(54) SPEAKER ASSEMBLY

(71) Applicant: AAC Technologies Pte. Ltd., Singapore (SG)

(72) Inventor: Bo Xiao, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/528,631

(22) Filed: Aug. 1, 2019

(65) Prior Publication Data

US 2020/0045453 A1 Feb. 6, 2020

(30) Foreign Application Priority Data

Aug. 4, 2018 (CN) ..... 201821261986.8

(51) Int. Cl.

| | |
|---|---|
| ***H04R 9/04*** | (2006.01) |
| ***H04R 9/02*** | (2006.01) |
| ***H04R 7/12*** | (2006.01) |
| ***H04R 9/06*** | (2006.01) |
| ***H04R 7/18*** | (2006.01) |

(52) U.S. Cl.

CPC ..... *H04R 9/046* (2013.01); *H04R 7/122* (2013.01); *H04R 7/127* (2013.01); *H04R 7/18* (2013.01); *H04R 9/025* (2013.01); *H04R 9/06* (2013.01); *H04R 2400/11* (2013.01)

(58) Field of Classification Search

CPC ... H04R 9/04; H04R 9/02; H04R 9/06; H04R 9/046; H04R 9/025; H04R 9/043; H04R 7/127; H04R 7/18; H04R 2307/021; H04R 2307/029; H04R 2400/11

See application file for complete search history.

(56) References Cited

U.S. PATENT DOCUMENTS

| | | | | |
|---|---|---|---|---|
| 6,912,292 B2 * | 6/2005 | Sagren | ..... | H04R 1/24 381/421 |
| 2014/0270323 A1 * | 9/2014 | Permanian | ..... | H04R 9/043 381/394 |

* cited by examiner

*Primary Examiner* — Sunita Joshi
(74) *Attorney, Agent, or Firm* — W&G Law Group LLP

(57) ABSTRACT

The present disclosure discloses a speaker assembly including a frame with an accommodation space, a magnetic circuit system and a vibration system accommodated in the frame. The vibration system includes a first vibration system and a second vibration system which are arranged with an interval. The first vibration system includes a first diaphragm and a first voice coil driving the first diaphragm, the second vibration system includes a second diaphragm and a second voice coil driving the second diaphragm to vibrate. The first diaphragm and the second diaphragm have the same vibration direction. The present disclosure has two vibration systems which break through the restriction of the height of the voice coils in the traditional structure and therefore further improve the product performance.

7 Claims, 2 Drawing Sheets

SPEAKER ASSEMBLY

FIELD OF THE PRESENT DISCLOSURE

The present disclosure relates to the field of electroacoustic transducers, and more particularly to a speaker assembly for converting electrical signals into sounds.

DESCRIPTION OF RELATED ART

With the advent of the mobile Internet era, the number of smart mobile devices is increasing. Among many mobile devices, mobile phones are undoubtedly the most common and portable mobile terminal device. At present, one of the functions and diversity of the mobile phones is the high-quality music function, and the loudspeaker in a mobile phone is one of the necessary conditions to achieve the high-quality music function.

The speaker assembly generally comprises a frame, a vibration system and a magnetic circuit system for driving the vibration system to generate sound. The components mentioned above are accommodated in the frame, wherein, the vibration system comprise a diaphragm and a voice coil driving the diaphragm. Limited by performance requirements, the speaker assembly in the prior art uses the voice coil with a thin wall, and the voice coil exceeding a certain height cannot be made, and therefore the product cannot improve the performance by adjusting the voice coil height.

Thus, it is necessary to provide an improved speaker assembly to solve the problem above.

BRIEF DESCRIPTION OF THE DRAWINGS

Many aspects of the exemplary embodiment can be better understood with reference to the following drawings. The components in the drawing are not necessarily drawn to scale, the emphasis instead being placed upon clearly illustrating the principles of the present disclosure.

DETAILED DESCRIPTION OF THE EXEMPLARY EMBODIMENT

The present disclosure will hereinafter be described in detail with reference to an exemplary embodiment. To make the technical problems to be solved, technical solutions and beneficial effects of the present disclosure more apparent, the present disclosure is described in further detail together with the figure and the embodiment. It should be understood the specific embodiments described hereby is only to explain the disclosure, not intended to limit the disclosure.

Figure 1:
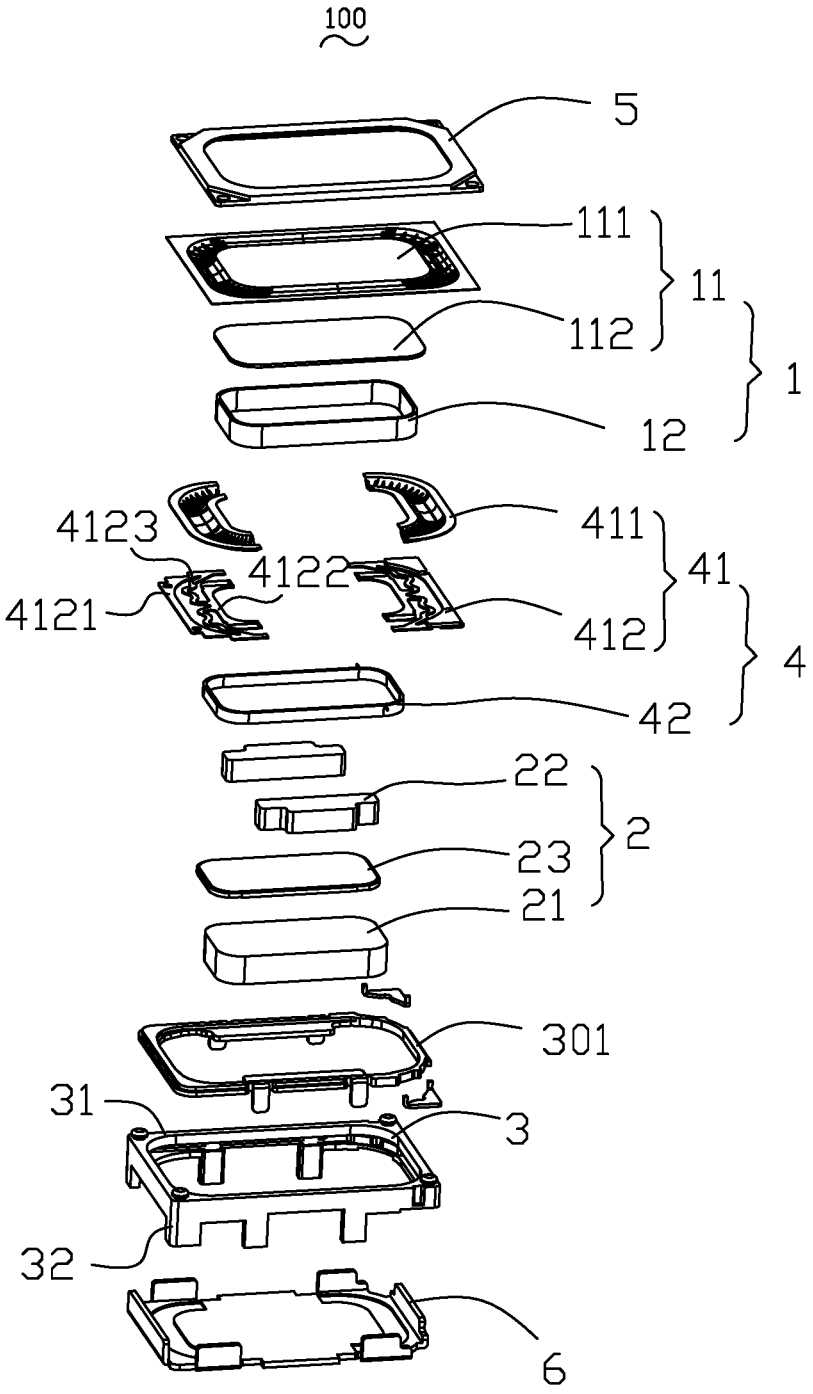
FIG. 1 is an exploded view of a speaker assembly in accordance with an exemplary embodiment of the present disclosure.
Figure 2:
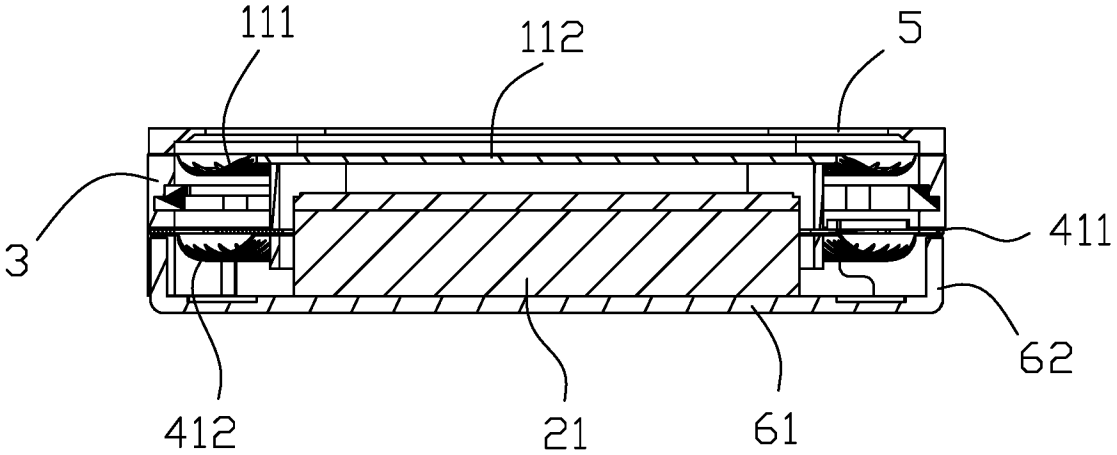
FIG. 2 is a cross-sectional view of the speaker assembly in FIG. 1.

As shown in FIGS. 1-2, the present disclosure provides a speaker assembly 100 which comprises a vibration system, a magnetic circuit system 2, and a frame 3 accommodating and fixing the vibration system and the magnetic circuit system 2.

The vibration system comprises a first vibration system 1 and a second vibration system 4 keeping a distance from the first vibration system 1.

The first vibration system 1 comprises a first diaphragm 11 and a first voice coil 12 for driving the first diaphragm 11 to vibrate. The first voice coil 12 is made by winding a voice coil lead wire. The first diaphragm 11 comprises a dome 112 and a first suspension 111 surrounding the dome 112.

The second vibration system 4 comprises a second diaphragm 41 and a second voice coil 42 for driving the second diaphragm 41 to vibrate. The second diaphragm 41 comprises a second suspension 411 and a spring 412 supporting the second suspension 411, wherein, a pair of the second suspension 411 and the spring 412 are provided and respectively symmetrically arranged at both sides of the second voice coil 42 and connected with the frame 3.

The frame 3 is a frame structure with an internal accommodation space, and comprises an upper surface 31, a lower surface (not shown) corresponding to the upper surface 31, and a fixing post 32 arranged on the lower surface, protruding towards the direction far away from the upper surface 31 and used for fixing and supporting. The first diaphragm 11 is adhered to the upper surface 31, and the second diaphragm 41 is fixed on the lower surface.

The first voice coil 12 abuts against an edge of the dome 112, and an edge of the first suspension 111 is fixed on the upper surface 31 of the frame 3. Further, the speaker assembly comprises an upper cover 5 covering the frame 3 and clamping and fixing the first diaphragm 11 with the frame 3. In the embodiment, the first suspension 111 and the dome 112 are formed in two pieces (separated parts). Of course, alternatively, the dome and the suspension can be formed integrally as a whole. The spring 412 connects to a side of the first voice coil 12 far away from the first diaphragm 11, the second suspension 411 is adhered to a side of the spring 412 far away from the first diaphragm 11, and the second voice coil 42 abuts against the side of the second suspension 411 far away from first diaphragm 11, namely, the second diaphragm 41 is clamped between the first voice coil 12 and the second voice coil 42. The first voice coil 12 and the second voice coil 42 are linked by the spring 412, and cooperatively drive the first diaphragm 11 and the second diaphragm 41 to vibrate to generate sound with the same frequency and range.

The spring 412 comprises a first fixing part 4121 connected with a lower surface of the frame 3, a second fixing part 4122 clamped between the first voice coil 12 and the second suspension 411, and an elastic connection part 4123 connecting with the first fixing part 4121 and the second fixing part 4122.

The magnetic circuit system 2 comprises a magnetic yoke 6 and a magnet arranged in the magnetic yoke 6. The magnet comprise a main magnet 21 located at a center of the magnetic yoke 6, a pair of auxiliary magnets 22 arranged at both sides of the main magnet 21 and a pole plate 23 adhered to the main magnet 21. A magnetic gap is formed between the main magnet 21 and the auxiliary magnets 22. The first voice coil 12 and the second voice coil 42 are inserted into the magnetic gap. When electrified, the first voice coil 12 and the second voice coil 42 are forced to vibrate due to Ampere Force which is produced by the interaction between the magnetic field in the magnetic gap and the electrified coils, further for driving the first diaphragm 12 and the second diaphragm 42 to vibrate along a vertical direction.

Preferably, the magnetic yoke comprises a bottom wall 61 and a side wall 62 bending and extending towards the second diaphragm 42 from a periphery of the bottom wall 61. The side wall 62 is assembled with the frame 3, and the first fixing part 4121 of the spring is fixed between the frame 3 and the side wall 62.

Preferably, a diameter of the first voice coil 12 is the same as that of the second voice coil 42, and projections of the first voice coil 12 and the second voice coil 42 in the vibration direction coincide with each other. Of course, in other optional embodiments, magnetic circuits of other structures can also be used, such as using annular auxiliary magnets or not using auxiliary magnets, which can also be implemented.

Further, a pad 301 is arranged in the frame 3, and the pad 301 is integrally formed with the inner part of the frame 3 by insertion-molding process and extends to the bottom end of the fixing post 32 and therefore the electrical connection between the speaker assembly and an external circuit is achieved.

The present disclosure discloses the speaker assembly which comprises the frame with the accommodation space, and the magnetic circuit system and the vibration system accommodated in the frame. The vibration system comprises the first vibration system and the second vibration system which are arranged with an interval. The first vibration system comprise the first diaphragm and the first voice coil driving the first diaphragm, the second vibration system comprises the second diaphragm and the second voice coil driving the second diaphragm to vibrate. The first diaphragm and the second diaphragm have the same vibration direction. The present disclosure has two vibration systems which break through the restriction of the height of the voice coils in the traditional structure and therefore further improve the product performance.

It is to be understood, however, that even though numerous characteristics and advantages of the present exemplary embodiment have been set forth in the foregoing description, together with details of the structures and functions of the embodiment, the disclosure is illustrative only, and changes may be made in detail, especially in matters of shape, size, and arrangement of parts within the principles of the invention to the full extent indicated by the broad general meaning of the terms where the appended claims are expressed.

What is claimed is:

1. A speaker assembly, including;

a frame with an accommodation space;

a magnetic circuit system accommodated in the frame;

a vibration system located in the accommodation space; wherein the vibration system includes:

a first vibration system having a first diaphragm and a first voice coil for driving the first diaphragm;

a second vibration system keeping a distance from the first vibration system, the second vibration system having a second diaphragm and a second voice coil for driving the second diaphragm to vibrate; and wherein a vibration direction of the first diaphragm is same to a vibration direction of the second diaphragm;

the frame comprises an upper surface and a lower surface corresponding to the upper surface, the first diaphragm is fixed on the upper surface of the frame, and the second diaphragm is fixed on the lower surface of the frame.

2. The speaker assembly as described in claim 1, wherein the first diaphragm comprises a dome located at a center thereof and a first suspension surrounding the dome, and the first voice coil abuts against an edge of the dome.

3. The speaker assembly as described in claim 1, wherein the second diaphragm comprises a second suspension and a spring supporting the second suspension.

4. The speaker assembly as described in claim 3, wherein the spring abuts against a side of the first voice coil far away from the first diaphragm, the second suspension is adhered to a side of the spring far away from the first diaphragm, and the second voice coil abuts against the side of the second suspension far away from the first diaphragm.

5. The speaker assembly as described in claim 3, wherein the spring comprises a first fixing part connected with the frame, a second fixing part clamped between the first voice coil and the second suspension, and an elastic connection part connected with the first fixing part and the second fixing part.

6. The speaker assembly as described in claim 5, wherein the magnetic circuit system comprises a magnetic yoke and a magnet carried by the magnetic yoke; the magnet comprises a main magnet located at a center of the magnetic yoke and at least one auxiliary magnet for forming a magnetic gap cooperatively with the main magnet; the first voice coil and the second voice coil are inserted into the magnetic gap.

7. The speaker assembly as described in claim 6, wherein the magnetic yoke comprises a bottom wall and a side wall bending and extending towards the second diaphragm from an periphery of the bottom wall; the side wall is assembled with the frame, and the first fixing part of the spring is fixed between the frame and the side wall.

* * * * *